US012595106B2

(12) United States Patent
Berthold

(10) Patent No.: US 12,595,106 B2
(45) Date of Patent: Apr. 7, 2026

(54) MONO POLYESTER MATERIAL PACKAGE

(71) Applicant: GPI Flexibles AB, Lund (SE)

(72) Inventor: Anton Berthold, Dalby (SE)

(73) Assignee: GPI Flexibles AB, Lund (SE)

( * ) Notice: Subject to any disclaimer, the term of this patent is extended or adjusted under 35 U.S.C. 154(b) by 292 days.

(21) Appl. No.: 18/288,404

(22) PCT Filed: May 17, 2022

(86) PCT No.: PCT/EP2022/063244
§ 371 (c)(1),
(2) Date: Oct. 26, 2023

(87) PCT Pub. No.: WO2022/253563
PCT Pub. Date: Dec. 8, 2022

(65) Prior Publication Data

US 2024/0208710 A1 Jun. 27, 2024

(30) Foreign Application Priority Data

May 31, 2021 (SE) ..... 2150692-8

(51) Int. Cl.
*B65D 77/20* (2006.01)
*B65D 65/40* (2006.01)

(52) U.S. Cl.
CPC ..... *B65D 77/2044* (2013.01); *B65D 65/40* (2013.01); *B65D 2577/2025* (2013.01)

(58) Field of Classification Search
CPC ..... B65D 77/2044; B65D 65/40; B65D 2577/2025; B65D 77/2032; B65D 1/34; B65D 43/14; B65D 65/14; Y02W 30/80; B32B 27/36; B32B 2250/244; B32B 2307/514; B32B 2307/702; B32B 2307/7244
See application file for complete search history.

(56) References Cited

U.S. PATENT DOCUMENTS

| | | | |
|---|---|---|---|
| 6,691,886 | B1 | 2/2004 | Berndt et al. |
| 2018/0037388 | A1 | 2/2018 | Vinet et al. |
| 2021/0147134 | A1 | 5/2021 | Truitt |

FOREIGN PATENT DOCUMENTS

WO WO 2019/072872 A1 4/2019

OTHER PUBLICATIONS

International Search Report and Written Opinion for PCT/EP2022/063244 dated Aug. 25, 2022.

*Primary Examiner* — James C Yager
(74) *Attorney, Agent, or Firm* — Andrew N. Claerbout; FisherBroyles, LLC

(57) ABSTRACT

The present disclosure relates to a package, such as a food package, comprising a first part and a second part, the second part being sealed to the first part at a first part circumferential edge and in a circumferential attachment zone to form a sealed inner compartment, the attachment zone having a first peelable zone and a second non-peelable zone, the first part and the second part include polymeric materials, the package is a mono polyester material package, 95 wt % or more of the package is polyester material. The second part includes a laminate having an oriented Polyethylene Terephtalate (OPET) material layer and an amorphous Polyethylene Terephtalate (APET) layer, the amorphous Polyethylene Terephtalate layer facing the first part.

16 Claims, 2 Drawing Sheets

MONO POLYESTER MATERIAL PACKAGE

CROSS-REFERENCE TO RELATED APPLICATIONS

The present application is a national stage entry under 35 U.S.C. § 371 of International Patent Application No. PCT/EP2022/063244, filed on May 17, 2022, which claims the benefit of Swedish Patent Application No. 2150692-8, filed on May 31, 2021.

INCORPORATION BY REFERENCE

The disclosures of each of International Patent Application No. PCT/EP2022/063244, filed on May 17, 2022, and Swedish Patent Application No. 2150692-8, filed on May 31, 2021, are hereby incorporated by reference for all purposes as if presented herein in their entirety.

TECHNICAL FIELD

The present disclosure relates to a package, such as a food package, comprising a first part and a second part.

BACKGROUND OF THE INVENTION

In the area of disposable packages for food products, for example baked goods or sliced food products, such as sliced meet or dairy products etc., there is an ongoing need of diminishing the carbon footprint of such products, by minimizing the resource use for the disposable packages as well as making the containers recyclable. The packages referred to herein are packages comprising a base and a lid, such as a flexible film, being sealed to the base in a circumferential attachment zone to form a sealed inner compartment. When removing the lid from the base, the lid is often discarded and not properly recycled, since the base material and the lid materials have different requirements, they are conventionally made of different materials, which makes them difficult to recycle in the same system.

US 2018/0037388 relates to a thermoplastic package including a tray and a peelable lidding film having a first outer layer comprising a polyester copolymer heat sealing lacquer positioned within a seal area of the film; a second outer layer comprising an amorphous polyethylene terephthalate (APET); and a third layer positioned between the first and second outer layers which comprises an oriented polyethylene terephthalate (OPET).

US 2021/0147134 relates to a polymeric rigid tray and a polymeric film lidding, wherein the polymeric rigid tray and the polymeric film lidding may comprise the same polymer which may be polyethylene terephthalate (PET).

An object of the present disclosure is to improve the recyclability and thus diminish the carbon footprint of disposable packages, such as for food products.

SUMMARY OF THE INVENTION

The above object may be achieved with a package according to claim 1. Further advantages and advantageous features of the invention are disclosed in the following description and in the dependent claims.

A package, such as a food package, according to the present disclosure comprises a first part and a second part. The second part is sealed to the first part at a first part circumferential edge and in a circumferential attachment zone to form a sealed inner compartment. The attachment zone comprises a first peelable zone and a second non-peelable zone. The first and the second part comprises polymeric materials and the package is a mono polyester material package and at least 95 wt. % of the package consists of polyester material. The second part comprises a laminate comprising an oriented Polyethylene Terephtalate (OPET) material layer and an amorphous Polyethylene Terephtalate (APET) layer, the amorphous Polyethylene Terephtalate layer facing the first part.

Packages, being disposable packages, made of polymeric materials and comprising a first part and a peelable second part, such as a base and a peelable lid, are conventionally manufactured using different materials for the first part and for the second part. A peelable lid, such as in the form of a flexible film, needs to be flexible and able to be sealed to the base, while the base needs to be more robust and dimensionally stable. These different requirements lead to the use of certain materials, such as polymeric materials, fulfilling the lid requirements for the lid part, and the use of other materials, such as other polymeric materials, being more suitable for the base part for the manufacturing of the base part.

From a manufacturing and package performance point of view, this provides a facilitated manufacturing and an enhanced package with the different parts being optimized in terms of materials having properties corresponding to the needs of the different parts.

However, from a recyclability point of view this is not optimal. Since the first part and the second part may be made from different materials and/or polymer blends, they are difficult to recycle together, in particular since the lid is fixedly attached to the base along a section of the base upper edge. The inventors have found that by manufacturing the package as a mono polyester material package, the recyclability is greatly enhanced.

For food packages comprising a first base part for storing the food and a second lid part for covering the food, it has been found that the lid is often discarded and not properly recycled. According to the present disclosure, the second part is fixedly attached to the first part along a section and the second part will therefore not be thrown away upon opening of the package and the chances that the entire package is properly recycled is greatly enhanced.

The package according to the present disclosure is a "mono polyester material package" and consists of at least 95 wt %, relative to the total weight of the package, polyester material, meaning that at least 95 wt % of the package consists of polymers containing the ester functional group in every repeat unit of their main chain. At least 95 wt % of the package material does thus not comprise a polymeric blend of other polymer types than polyester. The mono polyester material may include polymeric materials containing the ester functional group in every repeat unit of their main chain, but which materials have been subjected to different types of processing or thermal history.

The package is a mono polyester material package and at least 95 wt % of the package consists of the polyester material. The remaining 5 wt % may, for example, be a pigment and a thin layer of an oxygen barrier layer.

At least 97 wt % of the package may consist of the mono polyester material, optionally at least 97.5 wt % of the package may consist of the mono polyester material.

The first part may be a base and the second part may be a lid.

The package may comprise a varnish in the first peelable zone, providing a peelable attachment between the base and the lid in the first peelable zone, the varnish being a polyester-based varnish. The fact that the varnish is a polyester-based varnish improves the recyclability of the package.

The varnish may be a polyester based varnish, such as a Polyethylene Terephtalate (PET) based varnish. The varnish may be a polyester based varnish comprising at least 50 wt %, relative to the total weight of the varnish, of polyester. Optionally the varnish is a polyester based varnish comprising at least 80 wt %, relative to the total weight of the varnish, of polyester. The varnish may be a polyester based varnish comprising at least 90 wt %, relative to the total weight of the varnish, of polyester. The polyester may be copolyester, alternatively, 50 wt %, 80 wt % or 90 wt % polyester may be a polyester material consisting of polymers containing the ester functional group in every repeat unit of their main chain, such that the material does thus not comprise a polymeric blend of other polymer types than polyester.

The varnish may be a mono polyester varnish, such as a mono Polyethylene Terephtalate (PET) varnish. Providing the package with a varnish in the same mono polyester material as the first and second part gives a multi-component 100% recyclable package and, thus, reduced waste.

The varnish may be applied in an amount within the range from 0.5 $g/m^2$ to 5 $g/m^2$, optionally within the range from 0.5 $g/m^2$ to 2.5 $g/m^2$.

The varnish may constitute less than 5 wt % of the total package.

The varnish may cover from 20% to 50% of the surface area of the circumferential edge in the circumferential attachment zone. The varnish may be applied in a pattern over the circumferential edge in the attachment zone only covering parts of the circumferential edge in the attachment zone.

The second part, such as a lid, comprises a laminate comprising an oriented PET (OPET) material layer and an amorphous PET (APET) layer, the APET layer facing the tray. The OPET material layer is a heat-resistant layer and the APET layer is a heat-sealable layer, hence, such laminate provides a flexible material which may advantageously be heat-sealed to the first part. The lid may comprise a coPET layer, only including polymers containing ester functional group in every repeat unit of their main chain, being the layer facing the varnish. The APET layer may be arranged between the OPET layer and the coPET layer.

By arranging the APET layer in the laminate comprised in the second part such that it faces the first part, the APET layer constitutes a sealing layer when sealing the second part of the package to the first part.

The APET layer provides heat sealability of the second part without the need for a particular sealing layer or coating material having to be applied to the second part.

The circumferential attachment zone may be a circumferential heat-sealed attachment zone. Heat-sealed attachments enable fixed attachment, i.e., non-peelable attachment, between the first and the second part without any additional components impairing the recyclability of the package. A fixed attachment as referred to herein, is an attachment which cannot be broken without rupturing or otherwise damaging the material in the package.

The lid may be a flexible film.

The lid may comprise an oxygen barrier layer, the oxygen barrier layer being a silicon oxide layer or an aluminium oxide layer or a combination thereof. These types of oxygen barrier layers may provide an oxygen barrier while being extremely thin layers and thus not impairing the recyclability of the package.

The oxygen barrier layer may have a thickness within the range of from 0.001 μm to 1 μm. Such thin layers do not have an impact on the recyclability of the package and is therefore particularly suitable for a package according to the present disclosure.

The first part, such as a base, may be made of amorphous PET (APET). APET is a clear strong lightweight plastic well suited as a packaging material for food, since APET softens at temperatures around 80° C. it is furthermore suitable for use in heat-sealed packages.

In a package according to the present disclosure, 50 wt % or more of the polyester material may be a Polyethylene Terephtalate (PET) material, optionally 70 wt % or more, 80 wt % or more, or 90 wt % or more of the polyester material in the mono polyester package is PET material. Optionally, at least 95 wt. % of the package consists of PET material. It has been found that PET material is particularly well suited as in a mono polyester package and may be used both as a base part, lid part and varnish depending on the processing and thermal history of the PET material.

The first peelable zone may have an extension, as seen in the circumferential direction of the base circumferential upper edge, and the second non-peelable zone may have an extension, as seen in a circumferential direction of the base circumferential upper edge, and wherein the extension of the second non-peelable zone constitute from ⅕ to ½ of the total extension of the attachment zone. This provides a secure fixed attachment at the non-peelable zone, preventing unintentional removal of the entire second part and this improved recycling of the package according to the present disclosure.

The base may have a first and a second longitudinal base wall and a first and a second transverse base wall.

The second non-peelable zone of the circumferential attachment zone may be arranged along the base circumferential upper edge of the first or second transverse base wall.

BRIEF DESCRIPTION OF THE DRAWINGS

The present invention will be further explained hereinafter by means of non-limiting examples and with reference to the appended drawings wherein.

DETAILED DESCRIPTION OF PREFERRED EMBODIMENTS

It is to be understood that the drawings are schematic and that individual components, such as layers of materials and container components are not necessarily drawn to scale. The package 1 shown in the figures is provided as an example only and should not be considered limiting to the invention. Accordingly, the scope of the invention is determined solely by the scope of the appended claims.

Figure 1:
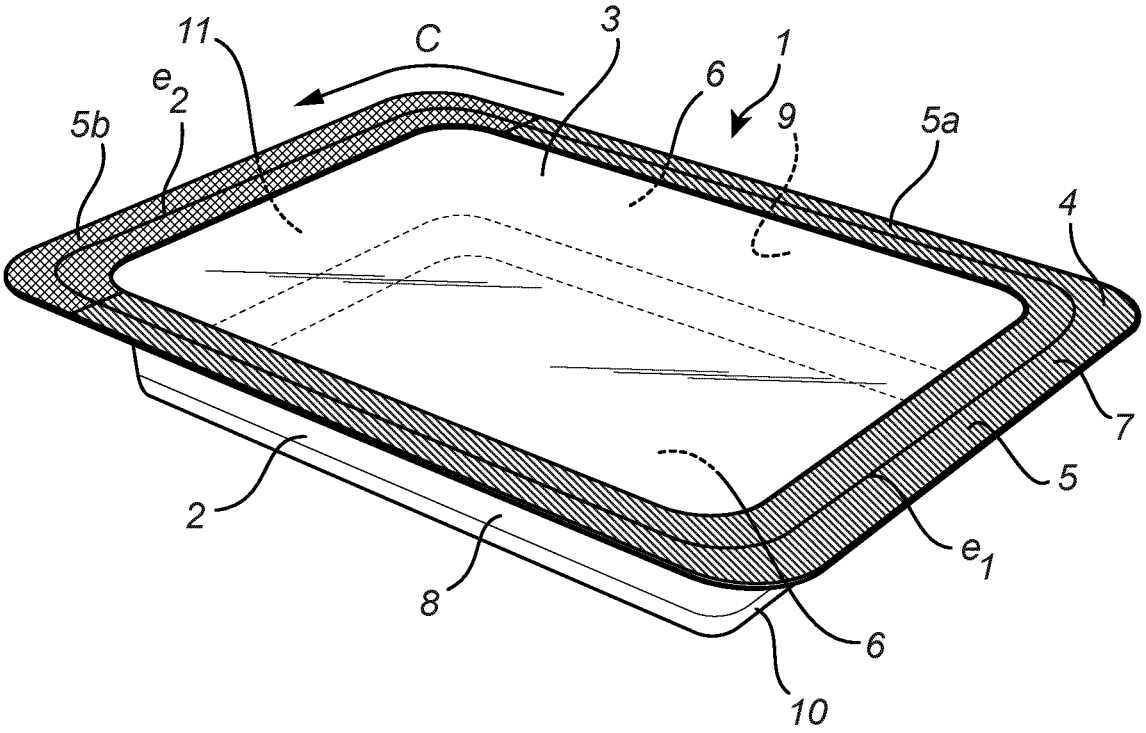
FIG. 1 illustrates a package according to the present disclosure.

FIG. 1 illustrates a package 1, here a disposable food package, comprising a first part 2, here a base, and a second part 3, here a lid. The package 1 is in this figure has a rectangular cross-section with first and second longitudinal side walls 8,9 and first and second transverse side walls 10,11.

The lid 3 is sealed to the base 2 at a base circumferential edge 4 and in a circumferential attachment zone 5 and thus a sealed inner compartment 6 is formed between the lid 3 and the base 2. The circumferential attachment zone 5 comprises a first peelable zone 5*a* and a second non-peelable zone 5*b* for allowing separation of the lid 3 from the base 2 in the first peelable zone 5*a*, while providing a fixed attachment between the lid 3 and the base 2 in the non-peelable zone 5*b* such that the lid 3 remains partially attached along the base circumferential edge 4. The base circumferential edge 4 extends in a circumferential direction C, and the first peelable zone 5*a* has an extension e1, as seen in the circumferential direction C and the second non-peelable zone has an extension e2, as seen in the circumferential direction C. The extension e2 of the second non-peelable zone may constitute from ⅕ to ½ of the total extension of the attachment zone 5, i.e., the sum of the extension e1 of the first peelable zone and the extension e2 of the second non-peelable zone 5*b*. The extension e2 of the second non-peelable zone may constitute from ⅕ to ⅓ of the total extension of the attachment zone 5. In FIG. 1, the first peelable zone 5*a* is arranged along the base circumferential edge 4 of the first and second longitudinal side walls 8,9 and the first transverse side wall 10 and the second non-peelable zone 5*b* is arranged along the base circumferential edge 4 of the second transverse side wall 11. The second non-peelable zone 5*b* furthermore extends over the corner portions of the base circumferential edge 4 between the second transverse side wall 11 and the respective first and second longitudinal transverse side walls 8,9.

The base 2 and the lid 3 may each be made of mono polyester material, such as a Polyethylene Terephtalate (mono PET) material. The base 2 may, for example, be of an amorphous PET (APET). The thickness of the base 2 may be from 150 μm to 1000 μm, such as 150 μm to 800 μm. The lid 3 may have a thickness of from 10 μm to 140 μm. Examples on suitable PET materials for the base and the lid are; Indorama Ramapet N 180, Indorama Ramapet N1, Equipolymers Lighter C 93, Neo Group Neopet 80.

The lid 3 may be a flexible film layer attached to the base 2 along the base circumferential edge 4 by heat-sealing and the first peelable zone 5*a* may be provided by applying a varnish 7 at the second non-peelable zone 5*b* of the attachment zone 5 prior to the heat-sealing. The varnish 7 may for example be applied to the lid 3 by gravure printing in an amount of from 0.5 g/m$^2$ to 5 g/m$^2$, optionally within the range from 0.5 g/m$^2$ to 2.5 g/m$^2$, in a frame pattern corresponding to the attachment zone 5 on an inner side 12 of the lid 3 facing the inner compartment 6. The varnish 7 may be applied only at the circumferential attachment zone 5, optionally in a pattern partially covering the attachment zone 5 of the circumferential edge 4. The varnish 7 is a polyester-based material of the package 1 and may comprise a blend with and/or monomer rests from other polymers. The varnish may for example be a blend of polyester and polyacrylate. The varnish may be constituted of at least 50 wt %, such as at least 60 wt %, or 80 wt % of polyester, based on the total weight of the varnish. Examples on suitable polyester based varnishes are Coim Novacote EX-8377, Coim Novacote HS 8416 and Henkel Loctite Liofol HS 1138 from Henkel Adhesives, The varnish may alternatively be a mono polyester varnish, for example of the same polyester material as the base 2 and the lid 3. The varnish may for example be a mono-PET varnish. An example on a mono polyester varnish is Coim Novacote EX8001. The mono polyester material may include polymeric materials having the same type of polymeric material, i.e., the same type of monomer, but which materials have been exerted to different types of processing or thermal history. The base 2 and/or the lid 3 may be provided with pigment in an amount within the range of from 0.1 to 5 g/m$^2$, optionally in an amount within the range of from 0.5 to 3 g/m$^2$, based on the total projected surface area of the package.

Figure 2:
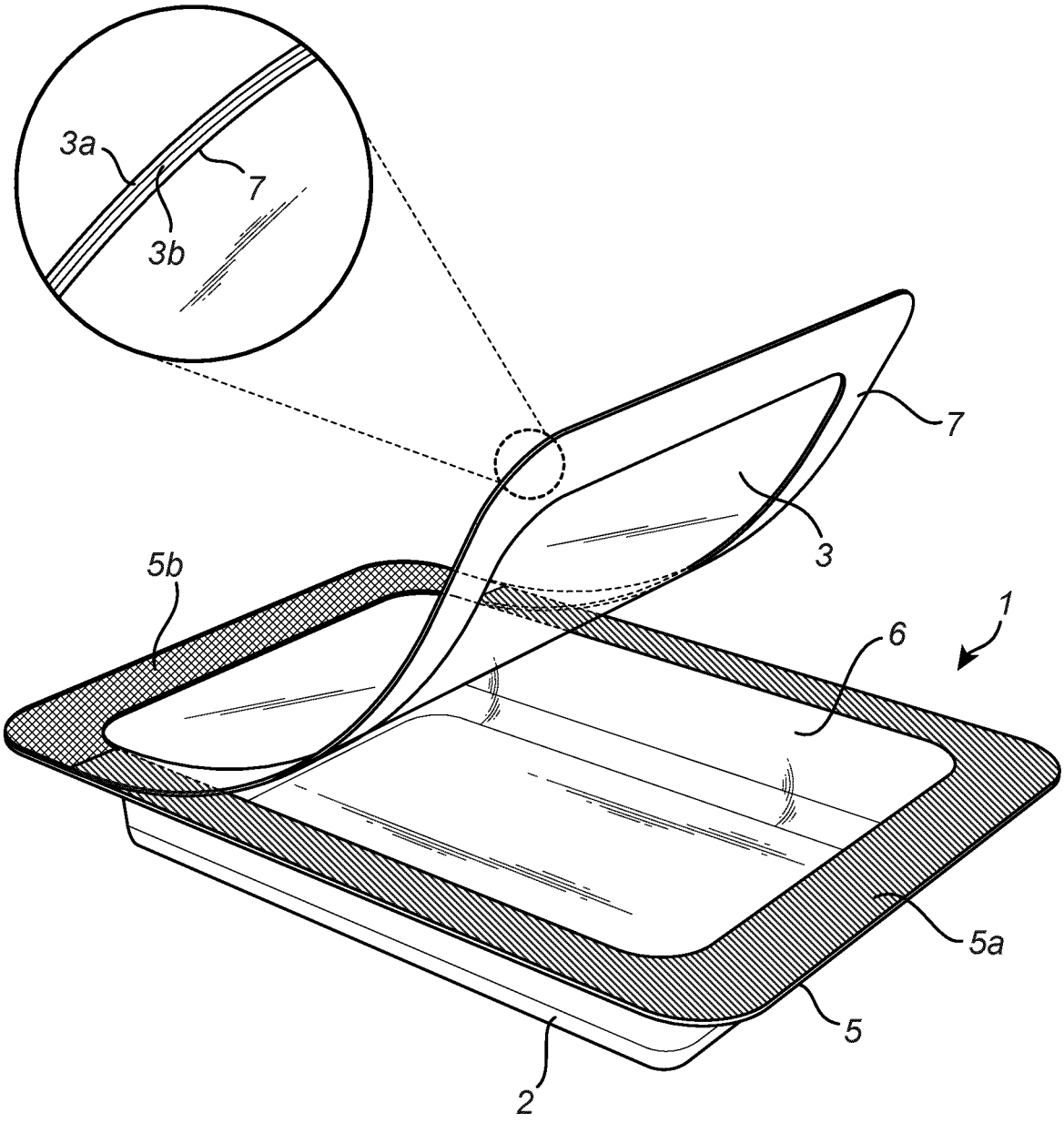
FIG. 2 illustrates a package with the second part being separated from the first part along the first peelable zone.

FIG. 2 illustrates the package 1 from FIG. 2 when the lid 3 has been separated from the base 2 at the first peelable zone 5*a*, thus exposing the inner compartment 6.

The lid 3 may be a laminate comprising a first layer 3*a* facing the inner compartment 6 and a second layer 3*b* facing away from the inner compartment 6. The varnish 7 may be applied as in a frame pattern 3*c* corresponding to the size and planar shape of the circumferential attachment zone 5 in the peelable zone 5*a*. The first layer 3*a* of the laminate may be an oriented PET (OPET) material layer and the second layer 3*b* may amorphous PET (APET). The lid 3 may additionally comprise a coPET layer as an inner sealing layer, i.e. a layer facing the varnish 7. An example on such coPET material is Eastman Eastar GP 002, Eastman Eastobond 19412 and Dow Appeel 93D894. The sealing layer comprising a coPET layer will constitute less than 5 wt % of the total weight of the package 1.

The invention claimed is:

1. A package comprising a first part and a second part, the second part being sealed to the first part at a first part circumferential edge and in a circumferential attachment zone) to form a sealed inner compartment, the circumferential attachment zone comprising a first peelable zone and a second non-peelable zone, the first part and the second part comprising polymeric materials, the package is a mono polyester material package and at least 95 wt % of the package comprises polyester material and wherein the second part comprises a laminate comprising an oriented Polyethylene Terephtalate (OPET) material layer and an amorphous Polyethylene Terephtalate (APET) layer, the amorphous Polyethylene Terephtalate layer facing the first part.

2. The package according to claim 1, wherein the first part is a base and the second part is a lid.

3. The package according to claim 1, wherein the package in the first peelable zone comprises a varnish providing a peelable attachment between the base and the lid in the first peelable zone, the varnish being a polyester-based varnish.

4. The package according to claim 3, wherein the polyester-based varnish comprises at least 50 wt % polyester of the total weight of the varnish), optionally at least 80 wt % polyester of the total weight of the varnish.

5. The package according to claim 3, wherein the varnish is a Polyethylene Terephtalate (PET) varnish comprising at least 50 wt %, of the total weight of the varnish, of Polyethylene Terephtalate, optionally at least 80 wt % of Polyethylene Terephtalate.

6. The package according to claim 3, wherein the varnish is applied in an amount within the range from 0.5 g/m$^2$ to 5 g/m$^2$, optionally within the range from 0.5 g/m$^2$ to 2.5 g/m$^2$.

7. The package according to claim 3, wherein the varnish covers from 20% to 50% of the circumferential edge in the circumferential attachment zone.

8. The package according to claim 1, wherein the circumferential attachment zone is a circumferential heat-sealed attachment zone.

9. The package according to claim 1, wherein the second part is a flexible film.

10. The package according to claim 1, wherein the second part comprises an oxygen barrier layer, the oxygen barrier layer being a silicon oxide layer or an aluminum oxide layer or a combination thereof.

11. The package according to claim 10, wherein the oxygen barrier layer has a thickness within the range of from 0.001 μm to 1 μm.

12. The package according to claim 1, wherein the first part is made of amorphous PET (APET).

13. The package according to claim 1, wherein at least 50 wt % or more of the polyester material is a Polyethylene Terephtalate (PET) material.

14. The package according to claim 1, wherein the first peelable zone has an extension, as seen in the circumferential direction of the first part circumferential edge, and the second non-peelable zone has an extension, as seen in a circumferential direction of the first part circumferential edge, and wherein the extension of the second non-peelable zone constitute from ⅕ to ½ of the total extension of the attachment zone.

15. The package according to claim 1, wherein the first part has a first longitudinal wall and a second longitudinal wall and a first transverse wall and a second transverse wall.

16. The package according to claim 15, wherein the second non-peelable zone of the circumferential attachment zone is arranged along the first part circumferential edge of the first or second transverse wall of the first part.

* * * * *